United States Patent [19]

DuPlessis

[11] Patent Number: 4,971,756

[45] Date of Patent: Nov. 20, 1990

[54] METHOD FOR PRODUCING DIES FOR USE IN COMPACTING PERMANENT MAGNET ALLOY POWDERS

[75] Inventor: John J. DuPlessis, Elizabethtown, Ky.

[73] Assignee: Crucible Materials Corporation, Pittsburgh, Pa.

[21] Appl. No.: 350,941

[22] Filed: May 12, 1989

[51] Int. Cl.[5] ..... B22F 32/00

[52] U.S. Cl. ..... 419/14; 419/28; 419/32; 419/49; 419/11; 419/31

[58] Field of Search ..... 419/32, 49, 28, 66, 419/14, 31, 11; 75/226

[56] References Cited

U.S. PATENT DOCUMENTS 4,023,966 5/1977 Loersch et al. ..... 75/226

4,592,889 6/1986 Leupold et al. ..... 419/66

*Primary Examiner*—Stephen J. Lechert, Jr.

*Assistant Examiner*—Nina Bhat

*Attorney, Agent, or Firm*—Finnegan, Henderson, Farabow, Garrett & Dunner

[57] ABSTRACT

Producing a die for use in compacting permanent magnet alloy powder by placing a quantity of a magnetic or nonmagnetic alloy, which may be stainless steel, cobalt- or nickel-base, or a magnetic or nonmagnetic mixture of one of these alloys and carbide particles in a container, heating the particles to an elevated temperature and hot-isostatically compacting the particles at the elevated temperature to obtain a fully dense die blank and forming a die cavity in the die blank. Carbide particles may be mixed with the alloy particles. The die blank may have an exterior cladding of stainless steel.

6 Claims, No Drawings

METHOD FOR PRODUCING DIES FOR USE IN COMPACTING PERMANENT MAGNET ALLOY POWDERS

BACKGROUND OF THE INVENTION

1. FIELD OF THE INVENTION

This invention relates to a method for producing powder metal dies such as for use in the compacting of permanent magnet alloy powders to produce therefrom fully dense, consolidated articles.

2. DESCRIPTION OF THE PRIOR ART

It is known to produce permanent magnets from permanent magnet alloys that are consolidated in powder form into substantially fully dense articles. Permanent magnet alloys of this type include barium and strontium ferrite, as well as alloys including rare earth elements in combination with transition elements.

In powder metallurgy operations and particularly the production of magnets the alloy is produced in particle form of usually less than 100 microns. These powder particles are pressed in mechanical or hydraulic presses using die presses well known in the powder metallurgy industry.

In magnet production practices of this type, it is common to orient the powder particles while in the die of the die pressing apparatus by the use of a magnetic field to cause the particles to align with their best magnetic crystallographic direction parallel to the applied magnetic field. Magnets having this alignment are commonly termed anisotropic magnets.

In the production of anisotropic magnets, and particularly during the magnetic alignment operation, the die in which the magnet alloy particles are contained for alignment and die pressing must be nonmagnetic. Otherwise, the magnetic flux would be short-circuited through the die to result in insufficient alignment or misalignment of the particles within the die.

Since magnet alloy particles of these compositions are extremely abrasive, during the die pressing operation the die cavity is subjected to high wear conditions. Consequently, it is typical to produce dies for this application of nonmagnetic, wear resistant alloys, such as austenitic stainless steels, bronze and brass alloys and nickel base alloys. These alloys are typically cast or forged to form a die block with the required die cavity being formed therein by machining and polishing operations. To enhance wear resistance the die cavity is clad or lined with a carbide, typically tungsten or molybdenum carbides. Alternately, the die cavity may be hardened by surface nitriding or applying a hard facing alloy by welding, flame spraying or vacuum deposition.

Conventional dies produced by the aforementioned practices are not only costly but the wear resistant cladding or surface hardening of the die cavity gives rise to premature failure by cracking or chipping because of the brittle nature of these die cavity surface portions.

SUMMARY OF THE INVENTION

It is accordingly a primary object of the present invention to provide a method for producing dies such as for use in die pressing permanent magnet alloy particles to form consolidated articles therefrom, wherein the provision of wear resistant die cavity portions is not required.

In accordance with the method of the invention, a die for use in compacting permanent magnet alloy powders for the production of magnets is produced by placing a quantity of particles of a wear-resistant magnetic or nonmagnetic alloy which may be stainless steel, a cobalt-base or nickel-base alloy in a container and heating the particles to an elevated temperature at which they are hot-isostatically compacted to obtain a fully dense die blank. A die cavity is formed in the die blank. Alternately, the particles may be a mixture of the alloy particles and carbide particles. The mixture may be produced by conventional mechanical alloying or mixing.

The die blank may be provided with an exterior cladding of stainless steel. This facilitates initial machining operations in producing the die from the die blank.

In accordance with the invention, the cobalt- and nickel-base alloys may be within the composition limits, in percent by weight, listed in Table I:

TABLE I

| Composition Limits for Cobalt and Nickel-Base Alloys | | | | | | | | | | | | |
|---|---|---|---|---|---|---|---|---|---|---|---|---|
| C | B | Mn | P | S | Si | Ni | Cr | Mo | W | Fe | Co | N |
| Nonmagnetic, Cobalt Base, Wear Resistant Alloys | | | | | | | | | | | | |
| 3.00 max | 2.50 max | 1.00 max | + | + | 3.00 max | 5.00 max | 15.00 35.00 | 2.00 max | 20.00 max | 5.00 max | Balance | + |
| Nonmagnetic, Nickel Base, Wear Resistant Alloys | | | | | | | | | | | | |
| 3.00 max | 3.50 max | 1.00 max | + | + | 4.50 max | Balance max | 10.00 30.00 | 20.00 max | 5.00 max | 30.00 max | 15.00 max | + |

+ residual amounts

DETAILED DESCRIPTION OF THE PREFERRED EMBODIMENTS

In accordance with a preferred embodiment of the invention, a quantity of particles of a nonmagnetic cobalt- or nickel-base alloy or a mixture of nonmagnetic stainless steel particles and carbide particles of a particle size of 100 microns or less are placed in a collapsible container suitable for hot-isostatic compacting. The particles within the container are compacted to final density. The compacting operation may be in accordance with well-known hot-isostatic compacting techniques for the consolidation of alloy particles, as exemplified by U.S. Pat. No. 3,700,435, issued Oct. 24, 1972, and U.S. Pat. No. 3,804,575, issued Apr. 16, 1974. The container which may be constructed in accordance with the teachings of these aforementioned patents is of a shape conforming to the desired die block.

Upon consolidation by hot-isostatic compacting to achieve full density, the container is removed from the consolidated die block article and a die cavity is provided by conventional machining and polishing operations.

Optionally, the portion of the powder filled container adjacent the container walls may be of stainless steel particles. In this manner, the final consolidated article will have a surface portion of stainless steel with the remainder being of a harder and more wear resistant material. This stainless steel outer layer on the consolidated article facilitates initial machining operations because the stainless steel is softer and thus more readily machinable than the remainder of the consolidated article.

If it is determined that the die block is to be consolidated with a portion thereof conforming to the desired die cavity, this may be achieved in accordance with the practice of the aforementioned U.S. Pat. No. 3,804,575. In this manner, subsequent machining and polishing operations incident to forming the die block cavity may be minimized to correspondingly reduce manufacturing costs.

What is claimed is:

1. A method for producing a die such as for use in compacting permanent magnet alloy powder, said method comprising placing a quantity of particles of a wear resistant stainless steel alloy which alloy may be either magnetic or nonmagnetic in a container, heating said particles to an elevated temperature, hot-isostatically compacting said particles to obtain a fully dense die blank, and forming a die cavity in said die blank.

2. The method of claim 1, wherein said quantity of particles is a mixture of said particles and carbide particles.

3. The method of claim 2 wherein said mixture is produced by mechanically alloying or mixing.

4. The method of claim 2 wherein said die blank has an exterior cladding of stainless steel.

5. A method for producing a die such as for use in compacting permanent magnet alloy powder, said method comprising placing a quantity of particles of a cobalt-base, nonmagnet alloy consisting essentially of, in weight percent, C 3.00 max, B 2.50 max, Mn 1.00 max, Si 3.00 max, Ni 5.00 max, Cr 15.00 to 35.00, Mo 2.00 max, Fe 5.00 max, Co balance in a container, heating said particles to an elevated temperature, hot-isostatically compacting said particles to obtain a fully dense die blank, and forming a die cavity in said die blank.

6. A method for producing a die such as for use in compacting permanent magnet alloy powder, said method comprising placing a quantity of particles of nickel-base, nonmagnetic alloy consisting essentially of, in weight percent, C 3.00 max, B 3.50 max, Mn 1.00 max, Si 4.50 max, Cr 10.00 to 30.00, Mo 20.00 max, W 5.00 max, Fe 30.00 max, Co 15.00 max, Ni balance in a container, heating said particles to an elevated temperature, hot-isostatically compacting said particles to obtain a fully dense die blank, and forming a die cavity in said die blank.

* * * * *